US006258498B1

(12) United States Patent
Kawahara et al.

(10) Patent No.: US 6,258,498 B1
(45) Date of Patent: Jul. 10, 2001

(54) ELECTROPHOTOGRAPHIC PHOTOSENSITIVE MEMBER, AND PROCESS CARTRIDGE AND ELECTROPHOTOGRAPHIC PHOTOSENSITIVE MEMBER

(75) Inventors: Masataka Kawahara; Takeshi Ikeda, both of Shizuoka-ken; Tetsuro Fukui; Takanori Matsuda, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/471,029

(22) Filed: Dec. 23, 1999

(30) Foreign Application Priority Data

Dec. 25, 1998 (JP) ..... 10-376496

(51) Int. Cl.[7] ..... G03G 5/05; G03G 1/147

(52) U.S. Cl. ..... 430/66; 430/56; 430/59.6; 430/67; 430/96; 399/116; 399/159

(58) Field of Search ..... 430/56, 59.6, 66, 430/67, 96, 99; 399/116, 159

(56) References Cited

U.S. PATENT DOCUMENTS 4,260,671 * 4/1981 Merrill ..... 430/67
5,332,635 * 7/1994 Tanaka ..... 430/96

FOREIGN PATENT DOCUMENTS 57-030843 2/1982 (JP) .
61-132954 6/1986 (JP) .
61-239248 10/1986 (JP) .
62-067094 3/1987 (JP) .
3-128973 5/1991 (JP) .
3-200790 9/1991 (JP) .
4-324454 11/1992 (JP) .

* cited by examiner

*Primary Examiner*—Janis L. Dote
(74) *Attorney, Agent, or Firm*—Fitzpatrick, Cella, Harper & Scinto

(57) ABSTRACT

An electrophotographic photosensitive member comprises a support and a photosensitive layer provided on the support. The electrophotographic photosensitive member has a surface layer which contains a polycarbonate resin having a structural unit represented by the following Formula (1):

(1)

8 Claims, 1 Drawing Sheet

FIGURE
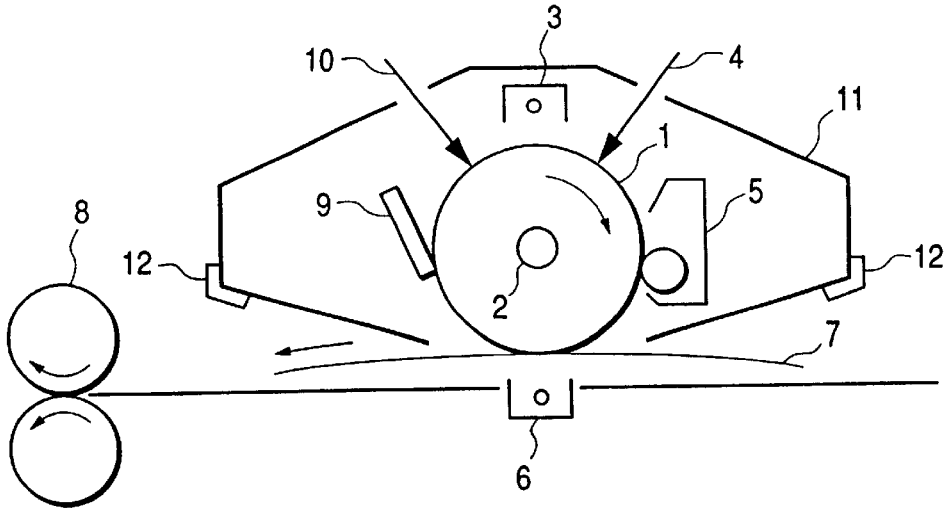

ELECTROPHOTOGRAPHIC PHOTOSENSITIVE MEMBER, AND PROCESS CARTRIDGE AND ELECTROPHOTOGRAPHIC PHOTOSENSITIVE MEMBER

BACKGROUND OF THE INVENTION

1. Field of the Invention

This invention relates to an electrophotographic photosensitive member, and a process cartridge and an electrophotographic apparatus which has the electrophotographic photosensitive member. More particularly, it relates to an electrophotographic photosensitive member having a surface layer containing a specific resin, and a process cartridge and an electrophotographic apparatus which have such an electrophotographic photosensitive member.

2. Related Background Art

Conventionally, inorganic photoconductive materials such as selenium, cadmium sulfide and zinc oxide have widely been used in photosensitive layers of electrophotographic photosensitive members. In recent years, research has been actively conducted on the use of organic photoconductive materials in the photosensitive layers of electrophotographic photosensitive members because they are very safe, are suited for mass production and are low in cost. A large number of photosensitive members have been proposed and put into practical use.

Mechanical external forces ascribable to charging means, developing means, transfer means, cleaning means and so forth are directly applied to the surfaces of electrophotographic photosensitive members, and the photosensitive members are required to have durabilities to these.

Since usually the organic photoconductive materials do not have any film-forming properties for themselves, they are commonly formed into films by the aid of binder resins. Accordingly, the mechanical durabilities of electrophotographic photosensitive members making use of organic photoconductive materials greatly relies on the selection of binder resins. Polystyrene, polymethyl methacrylate, and polycarbonate resin of bisphenol-A or bisphenol-Z type are conventionally used as the binder resins. In particular, the polycarbonate resin of the bisphenol-Z type is widely used as a binder for photosensitive members of medium- or low-speed copying machines or laser beam printers, and has greatly contributed to contemporary advancement of the electrophotographic photosensitive members making use of organic photoconductive materials.

However, further durabilities have had to be imparted to the photosensitive members in order to achieve their expansion to high-speed copying machines and to reduce copying cost.

Stated specifically, the photosensitive members are required to have further durabilities to wear and scratching of photosensitive member surfaces caused by friction and to deterioration of photosensitive member surfaces caused by ozone which tends to be generated at the time of corona charging in an environment of high humidity. Also, there is such a problem that toners may adhere to photosensitive member surfaces because of the repetition of development and cleaning. It is sought to improve cleanability of photosensitive member surfaces to cope with such problems.

In order to satisfy such various properties required for the photosensitive member surfaces, it has been variously attempted in variety to provide on the photosensitive layer a surface protective layer composed chiefly of a resin. For example, Japanese Patent Application Laid-open No. 57-30843 discloses a protective layer whose resistance has been controlled by adding metal oxide particles as conductive particles.

Studies have been conducted on adding substances of various types in surface layers so as to improve physical properties of photosensitive member surfaces. For example, because of the low surface energy of silicones, additives such as silicone oils (Japanese Patent Application Laid-open No. 61-132954), polydimethylsiloxanes, silicone resin powders, cross-linked silicone resins, poly(carbonate silicone) block copolymers, silicone-modified polyurethanes and silicone-modified polyesters have been reported. Also, typical polymers having a low surface energy include fluorine type macromolecules. The fluorine type macromolecules may include polytetrafluoroethylene powder and carbon fluoride powder.

The surface protective layers containing metal oxides can provide layers having a high hardness. However, such layers tend to have a large surface energy and hence tend to cause a problem on their cleanability. The silicone type resins are advantageous in view of a small surface energy, but have insufficient compatibility with other resins. Hence, they have had specific problems in that, when added, they tend to agglomerate to cause light scattering or to bleed and thus localize at the layer surface, thereby exhibiting unstable performances.

The fluorine type macromolecules are also commonly insoluble in solvents and also have a poor dispersibility. Hence, they have had problems such that smooth photosensitive member surfaces can be formed with difficulty, and light scattering tends to occur because of a small refractive index to cause a deterioration in transparency. The fluorine type macromolecules also have such problems in that they are commonly so soft as to be readily scratched.

In addition, the use of surface protective layers or additives is attended by a bad effect that they may worsen electrophotographic characteristics such as sensitivity and residual potential.

SUMMARY OF THE INVENTION

An object of the present invention is to provide an electrophotographic photosensitive member having a high mechanical durability and good electrophotographic performances.

Another object of the present invention is to provide a process cartridge and an electrophotographic apparatus which have such an electrophotographic photosensitive member.

The present invention provides an electrophotographic photosensitive member comprising a support and a photosensitive layer provided on the support; the electrophotographic photosensitive member having a surface layer which contains a polycarbonate resin having a structural unit represented by the following Formula (1):

(1)

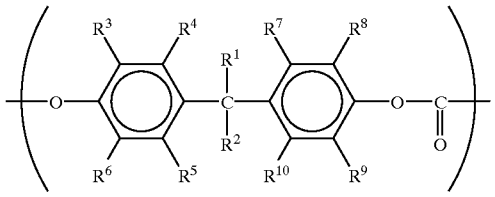

wherein $R^1$ represents a hydrogen atom, a halogen atom, a substituted or unsubstituted alkyl group, a substituted or unsubstituted aryl group, or a substituted or unsubstituted alkenyl group; $R^2$ represents an alkyl group having a hydroxyl group; and $R^3$ to $R^{10}$ each represent a hydrogen atom, a halogen atom, a substituted or unsubstituted alkyl group, a substituted or unsubstituted aryl group, a substituted or unsubstituted alkenyl group, a substituted or unsubstituted alkoxyl group, or a substituted or unsubstituted aralkyl group.

The present invention also provides a process cartridge and an electrophotographic apparatus which have the electrophotographic photosensitive member described above.

BRIEF DESCRIPTION OF THE DRAWING

FIGURE schematically illustrates an example of the construction of an electrophotographic apparatus having a process cartridge having the electrophotographic photosensitive member of the present invention.

DESCRIPTION OF THE PREFERRED EMBODIMENTS

The surface layer of the electrophotographic photosensitive member of the present invention contains a polycarbonate resin having a structural unit represented by the following Formula (1):

(1)

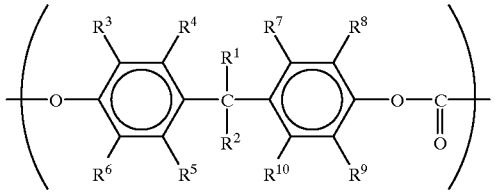

wherein $R^1$ represents a hydrogen atom, a halogen atom, a substituted or unsubstituted alkyl group, a substituted or unsubstituted aryl group, or a substituted or unsubstituted alkenyl group; $R^2$ represents an alkyl group having a hydroxyl group; and $R^3$ to $R^{10}$ each represent a hydrogen atom, a halogen atom, a substituted or unsubstituted alkyl group, a substituted or unsubstituted aryl group, a substituted or unsubstituted alkenyl group, a substituted or unsubstituted alkoxyl group, or a substituted or unsubstituted aralkyl group.

The halogen atom represented by $R^1$ in Formula (1) may include a fluorine atom, a chlorine atom and a bromine atom. The alkyl group may include a methyl group, an ethyl group, a propyl group and so forth, and may preferably have 1 to 5 carbon atoms. The aryl group may include a phenyl group, a naphthyl group and so forth, and may preferably have 6 to 12 carbon atoms. The alkenyl group may include a vinyl group, an allyl group and so forth, and may preferably have 2 to 5 carbon atoms. The alkoxyl group may include a methoxyl group, an ethoxyl group, a propoxyl group and so forth, and may preferably have 1 to 5 carbon atoms. The aralkyl group may include a benzyl group and so forth, and may preferably have 7 to 17 carbon atoms.

The substituent the groups represented by $R^1$ and $R^3$ to $R^{10}$ may each have may include the alkyl group, alkenyl group, alkoxyl group, halogen atoms as described above and a dimethylsiloxane group.

The polycarbonate resin having a structural unit represented by Formula (1) is obtainable by allowing a bisphenol represented by the following Formula (2):

(2)

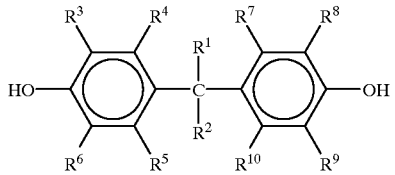

wherein $R^1$ to $R^{10}$ are as defined in Formula (1); to react with phosgene, a carbonate, or chloroformate. Here, the above bisphenol may be used alone or may be used in the form of a mixture with an additional bisphenol.

Preferred examples of the bisphenol represented by Formula (2) are shown below. The present invention is by no means limited to these.

2,2-Bis(4-hydroxyphenyl)propanol,
2,2-bis(4-hydroxy-3-methylphenyl)propanol,
2,2-bis(4-hydroxy-3,5-dimethylphenyl)propanol,
2,2-bis(4-hydroxy-3-fluorophenyl)propanol,
2,2-bis(4-hydroxy-3-chlorophenyl)propanol,
2,2-bis(4-hydroxy-3-bromophenyl)propanol,
2,2-bis(4-hydroxy-3,5-difluorophenyl)propanol,
2,2-bis(4-hydroxy-3,5-dichlorophenyl)propanol,
2,2-bis(4-hydroxy-3,5-dibromophenyl)propanol,
2,2-bis(4-hydroxyphenyl)ethanol,
2,2-bis(4-hydroxyphenyl)phenetyl alcohol,
2,2-bis(4-hydroxyphenyl)-3-methylbutanol, and
2,2-bis(4-hydroxyphenyl)-4-pentenol.

Of these, 2,2-bis(4-hydroxyphenyl)propanol is particularly preferred.

In the present invention, from the viewpoint of mechanical durability, the polycarbonate resin may preferably be a copolymer having the structural unit represented by Formula (1) and a structural unit(s) represented by the following Formula (3) and/or (4), or a mixture of the polycarbonate resin having the structural unit represented by Formula (1) with a polycarbonate resin having a structural unit represented by the following Formula (3) and/or a polycarbonate resin having a structural unit represented by the following Formula (4). Of these, a copolymer having at least the structural units represented by Formulas (1) and (3) may preferably be used in view of mechanical durability and solubility.

(3)

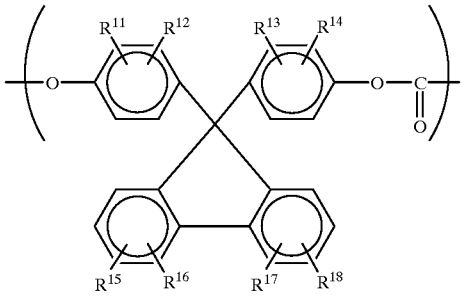

wherein $R^{11}$ to $R^{18}$ each represent a hydrogen atom, a halogen atom, a substituted or unsubstituted alkyl group, a substituted or unsubstituted aryl group, a substituted or unsubstituted alkenyl group, a substituted or unsubstituted alkoxyl group, or a substituted or unsubstituted aralkyl group.

(4)

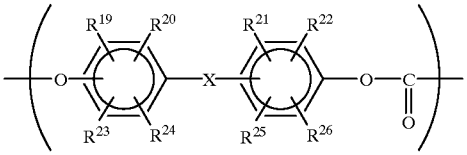

wherein $R^{19}$ to $R^{26}$ each represent a hydrogen atom, a halogen atom, a substituted or unsubstituted alkyl group, a substituted or unsubstituted aryl group, a substituted or unsubstituted alkenyl group, a substituted or unsubstituted alkoxyl group, or a substituted or unsubstituted aralkyl group; and X represents

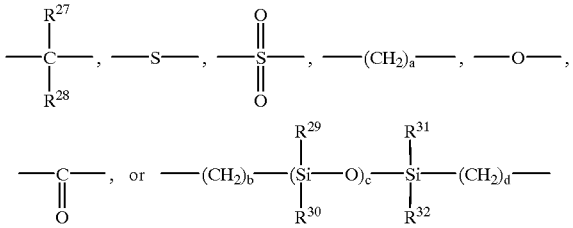

wherein $R^{27}$ and $R^{28}$ each represent a hydrogen atom, a halogen atom, a substituted or unsubstituted alkyl group, a substituted or unsubstituted aryl group or a substituted or unsubstituted alkenyl group, or a group necessary for $R^{27}$ and $R^{28}$ to combine together to form a carbon ring or a heterocyclic ring; $R^{29}$ to $R^{32}$ each represent a hydrogen atom, a substituted or unsubstituted alkyl group or a substituted or unsubstituted aryl group; and a, b and d are each an integer of 0 to 20, and c an integer of 1 to 500.

The halogen atom represented by $R^{11}$ to $R^{28}$ in Formulas (3) and (4) may include a fluorine atom, a chlorine atom and a bromine atom. The alkyl group may include a methyl group, an ethyl group, a propyl group and so forth, and may preferably have 1 to 5 carbon atoms. The aryl group may include a phenyl group, a naphthyl group and so forth, and may preferably have 6 to 12 carbon atoms. The alkenyl group may include a vinyl group, an allyl group and so forth, and may preferably have 2 to 5 carbon atoms. The alkoxyl group may include a methoxyl group, an ethoxyl group, a propoxyl group and so forth, and may preferably have 1 to 5 carbon atoms. The aralkyl group may include a benzyl group and so forth, and may preferably have 7 to 17 carbon atoms.

The carbon ring or heterocyclic ring may include a cyclohexane ring and a cycloheptane ring.

The substituent the groups represented by $R^{11}$ to $R^{26}$ may each have may include the alkyl group, alkenyl group, alkoxyl group, halogen atoms as described above and a dimethylsiloxane group. The substituent the groups represented by $R^{27}$ to $R^{32}$ may each have may include the alkyl group and halogen atoms as described above, a hydroxyl group and a dimethylsiloxyl group.

The polycarbonate resin having a structural unit represented by Formula (3) is obtainable by allowing a bisphenol represented by the following Formula (5):

(5)

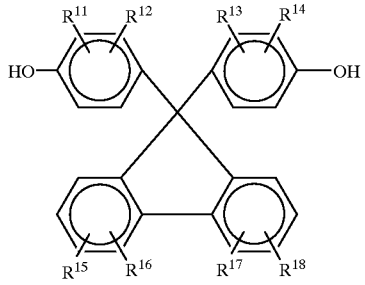

wherein $R^{11}$ to $R^{18}$ are as defined in Formula (3); to react with phosgene, a carbonate, or chloroformate. Here, the above bisphenol may be used alone or may be used in the form of a mixture with an additional bisphenol.

Preferred examples of the bisphenol represented by Formula (5) are shown below. The present invention is by no means limited to these.

Exemplary Compound 1

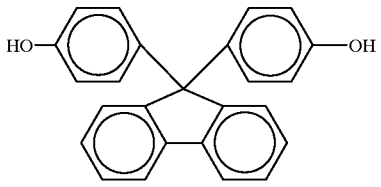

Exemplary Compound 2

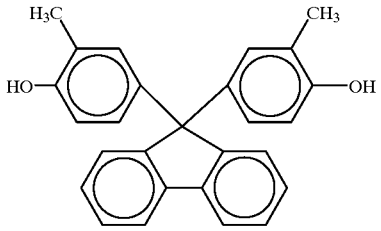

-continued
Exemplary Compound 3
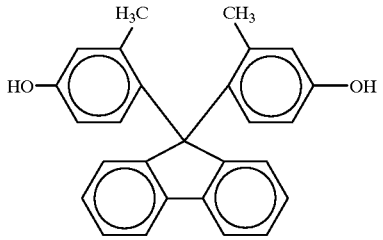
Exemplary Compound 4
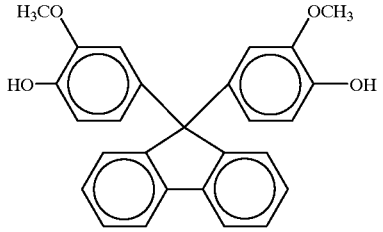
Exemplary Compound 5
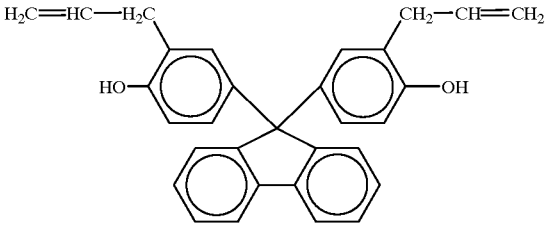
Exemplary Compound 6
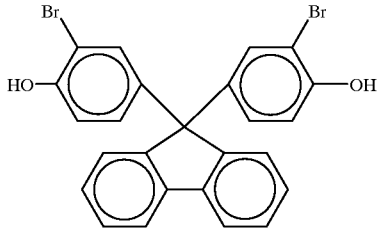
Exemplary Compound 7
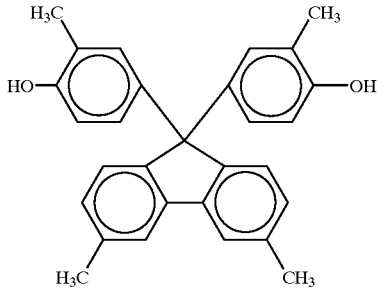
-continued
Exemplary Compound 8
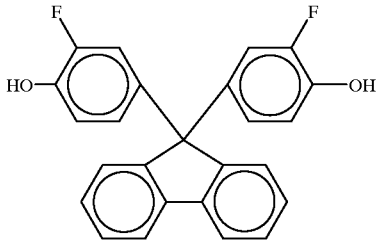
Exemplary Compound 9
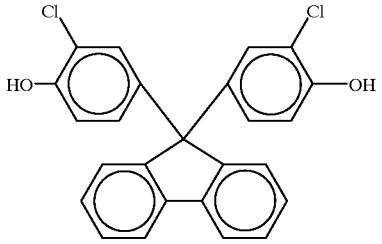
Exemplary Compound 10
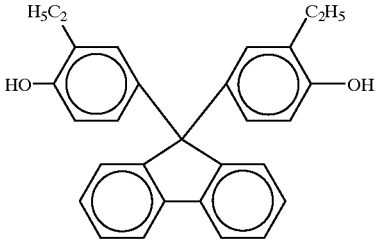
Exemplary Compound 11
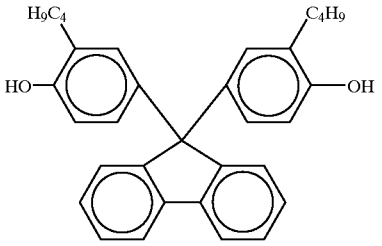
Exemplary Compound 12
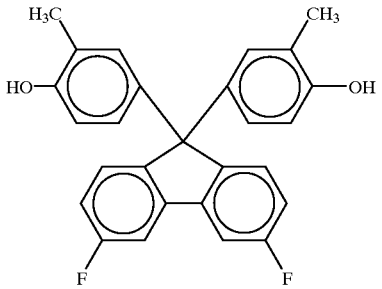

-continued

Exemplary Compound 13

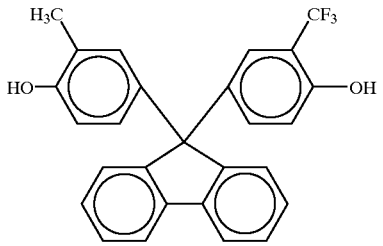

Exemplary Compound 14

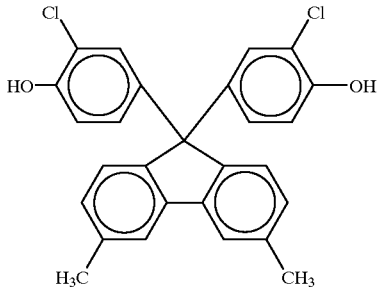

Of the foregoing exemplary compounds, 9,9-bis(4-hydroxy-3-methylphenyl)fluorene (Exemplary Compound 2) is particularly preferred. Also, Two or more of the foregoing compounds may be used in combination.

The polycarbonate resin having a structural unit represented by Formula (4) is obtainable by allowing a bisphenol represented by the following Formula (6):

(6)

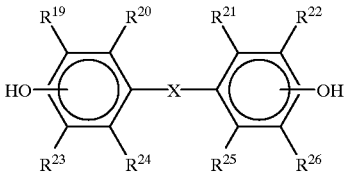

wherein $R^{19}$ to $R^{26}$ are as defined in Formula (4); to react with phosgene, a carbonate, or chloroformate. Here, the above bisphenol may be used alone or may be used in the form of a mixture with an additional bisphenol.

Preferred examples of the bisphenol represented by Formula (6) are shown below. The present invention is by no means limited to these.

Bis(4-hydroxyphenyl)methane,
bis(3-methyl-4-hydroxyphenyl)methane,
bis(3-chloro-4-hydroxyphenyl)methane,
bis(3,5-dibromo-4-hydroxyphenyl)methane,
bis(4-hydroxyphenyl)ether,
bis(3-methyl-4-hydroxyphenyl)ether,
bis(3-fluoro-4-hydroxyphenyl)ether,
bis(4-hydroxyphenyl)sulfone,
bis(3-methyl-4-hydroxyphenyl)sulfone,
bis(4-hydroxyphenyl)sulfoxide,
bis(3-methyl-4-hydroxyphenyl)sulfoxide,
bis(4-hydroxyphenyl)sulfide,
bis(3-methyl-4-hydroxyphenyl)sulfide,
bis(4-hydroxyphenyl)ketone,
bis(3-methyl-4-hydroxyphenyl)ketone,
1,1-bis(4-hydroxyphenyl)ethane,
1,1-bis(3-methyl-4-hydroxyphenyl)ethane,
1,1-bis(3-fluoro-4-hydroxyphenyl)ethane,
1,1-bis(2-tert-butyl-4-hydroxy-3-methylphenyl)ethane,
1,2-bis(4-hydroxyphenyl)ethane,
1,2-bis(3-methyl-4-hydroxyphenyl)ethane,
2,2-bis(4-hydroxyphenyl)propane,
2,2-bis(3-methyl-4-hydroxyphenyl)propane,
2,2-bis(3-cyclohexyl-4-hydroxyphenyl)propane,
2,2-bis(3-phenyl-4-hydroxyphenyl)propane,
2,2-bis(3,5-dimethyl-4-hydroxyphenyl)propane,
2,2-bis(3-fluoro-4-hydroxyphenyl)propane,
2,2-bis(3-chloro-4-hydroxyphenyl)propane,
2,2-bis(3-bromo-4-hydroxyphenyl)propane,
2,2-bis(3,5-difluoro-4-hydroxyphenyl)propane,
2,2-bis(3,5-dichloro-4-hydroxyphenyl)propane,
2,2-bis(3,5-dibromo-4-hydroxyphenyl)propane,
2,2-bis(2-tert-butyl-4-hydroxyphenyl-3-methylphenyl)propane,
2,2-bis(4-hydroxyphenyl)hexafluropropane,
2,2-bis(3-methyl-4-hydroxyphenyl)hexafluropropane,
2,2-bis(3,5-dimethyl-4-hydroxyphenyl)hexafluropropane,
2,2-bis(3-phenyl-4-hydroxyphenyl)hexafluropropane,
2,2-bis(3-fluoro-4-hydroxyphenyl)hexafluropropane,
2,2-bis(3-chloro-4-hydroxyphenyl)hexafluropropane,
2,2-bis(4-hydroxyphenyl)butane,
2,2-bis(3-methyl-4-hydroxyphenyl)butane,
2,2-bis(3,5-dimethyl-4-hydroxyphenyl)butane,
2,2-bis(3-fluoro-4-hydroxyphenyl)butane,
2,2-bis(3-chloro-4-hydroxyphenyl)butane,
2,2-bis(3-bromo-4-hydroxyphenyl)butane,
2,2-bis(3,5-difluoro-4-hydroxyphenyl)butane,
2,2-bis(3,5-dichloro-4-hydroxyphenyl)butane,
2,2-bis(3,5-dibromo-4-hydroxyphenyl)butane,
2,2-bis(2-tert-butyl-4-hydroxyphenyl-3-methylphenyl)butane,
1,1-bis(4-hydroxyphenyl)cyclohexane,
1,1-bis(3-methyl-4-hydroxyphenyl)cyclohexane,
1,1-bis(3-cyclo-4-hydroxyphenyl)cyclohexane,
1,1-bis(3-phenyl-4-hydroxyphenyl)cyclohexane,
1,1-bis(3,5-dimethyl-4-hydroxyphenyl)cyclohexane,
1,1-bis(3-fluoro-4-hydroxyphenyl)cyclohexane,
1,1-bis(3-chloro-4-hydroxyphenyl)cyclohexane,
1,1-bis(3-bromo-4-hydroxyphenyl)cyclohxane,
1,1-bis(3,5-difluoro-4-hydroxyphenyl)cyclohexane,
1,1-bis(3,5-dichloro-4-hydroxyphenyl)cyclohexane,
1,1-bis(3,5-dibromo-4-hydroxyphenyl)cyclohexane,
1,1-bis(2-tert-butyl-4-hydroxyphenyl-3-methylphenyl)cyclohexane,
4,4'-dihydroxybiphenyl,
4,4'-dihydroxy-3,3'-biphenyl,
4,4'-dihydroxy-2,2'-dimethylbiphenyl,
3,3'-difluoro-4,4'-dihydroxybiphenyl,
α, ω-bis[3-(o-hydroxyphenyl)propyl]polydimethylsiloxane,
α, ω-bis[3-(p-hydroxyphenyl)propyl]polydimethylsiloxane, and
α, ω-bis[4-(p-hydroxyphenyl)butyl]polydimethylsiloxane.

Any of these may be used in combination of two or more types.

The polycarbonate resin used in the present invention may preferably have an intrinsic viscosity of from 0.3 to 2.0 deciliter/gram.

In the polycarbonate resin used in the present invention, a chain terminating agent or a molecular weight modifier may usually be used, which may typically include compounds having a monovalent phenolic hydroxyl group, and may include ordinary phenol, p-tert-butylphenol and tribromophenol, and besides long-chain alkyl phenols, aliphatic carboxylic acid chlorides, aliphatic carboxylic acids, hydroxybenzoic acid alkyl esters, hydroxyphenyl alkyl acid esters and alkyl ether phenols.

It may be used in an amount of from 100 to 0.2 mole, and preferably from 50 to 2 moles, based on 100 moles of all the bisphenols. Two or more compounds may of course be used in combination.

A branching agent may also be used in the range of from 0.01 to 3 mole %, and particularly from 0.1 to 1.0 mole %, based on the above bisphenol type compound, to make up a branched polycarbonate resin. Such a branching agent may include polyhydroxyl compounds such as phloroglucin,
2,6-dimethyl-2,4-6-tri(hydroxyphenyl)heptene-3,
4,6-dimethyl-2,4,6-tri(hydroxyphenyl)heptene-2,
1,3,5-tri(2-hydroxyphenyl)benzole,
1,1,1-tri(4-hydroxyphenyl)ethane,
2,6-bis(2-hydroxy-5-methylbenzyl)-4-methylphenol and
α,α',α"-tri(4-hydroxyphenyl)-1,3,5-triisopropylbenzene, and also 3,3-bis(4-hydroxyaryl)oxyindole, 5-chloroisatin, 5,7-dichloroisatin and 5-bromoisatin.

In the case when the mixture of the polycarbonate resin having a structural unit represented by Formula (1) with the polycarbonate resin having a structural unit represented by Formula (3) and/or the polycarbonate resin having a structural unit represented by Formula (4) is used, a resin obtained by dissolving and mixing these polycarbonate resins in a solubilizing agent followed by reprecipitation with a bad solvent may be used. This enables the effect of the present invention to be remarkably achieved. This dissolution and reprecipitation may be carried out by a conventional process. For example, first, the polycarbonate resins are well dissolved in a solvent of a solubilizing agent such as dichloromethane or chloroform. Next, this mixed-polymer solution is reprecipitated from a bad solvent such as methanol or water to obtain a cottony polymer. The polymer thus obtained can be a polymer having solubility and coating stability superior to those of a polycarbonate resin obtained by merely blending the polymers.

Any detailed mechanism of such a phenomenon has not been elucidated. It is presumed that the prior blending of the respective polymers in the solvent enables the structure represented by Formula (1), structure represented by Formula (3) and structure represented by Formula (4) to be blended to a high degree and, in the resulting blend, the respective resins come into mutual molecular chains to make the product readily exhibit new properties. Also, it is presumed that since molecules having different structures are blended, the crystallizability of each resin is considered to be broken, and hence the solubility in solvents is considered to be improved, thus it becomes possible to keep gelation from occurring during storage.

In addition, in the present invention, the structural unit represented by Formula (1) may preferably be in an amount of from 5 to 90% by weight, and particularly from 7 to 60% by weight, based on the weight of the total resin in the surface layer.

As the support of the electrophotographic photosensitive member, a support having a conductivity in itself is usable, as exemplified by those made of aluminum, an aluminum alloy, copper, zinc, stainless steel, chromium, titanium, nickel, magnesium, indium, gold, platinum, silver or iron. Also usable are those comprising a plastic or the like dielectric substrate on which a coating has been formed by, e.g., vacuum deposition of aluminum, indium oxide, tin oxide or gold to provide a conductive layer, and those comprising a plastic or paper mixed with conductive fine particles.

In particular, a conductive layer obtained by applying a dispersion prepared by dispersing conductive fine particles in a polymer binder can be formed with ease, and is suited for the formation of a uniform surface. The conductive fine particles used in such an instance may have a primary particle diameter of 100 nm or smaller, and preferably 50 nm or smaller. As the conductive fine particles, usable are particles of conductive zinc oxide, conductive titanium oxide, aluminum, gold, copper, silver, cobalt, nickel, iron, carbon black, ITO (indium-tin-oxide), tin oxide, indium oxide or indium. Any of these may be applied on the surfaces of insulating fine particles. The above conductive fine particles may be so used that the conductive layer may have a sufficiently low volume resistivity, and may be so added that it may preferably have a resistance of $1\times10^{10}$ Ω·cm or below, and more preferably $1\times10^{8}$ Ω·cm or below.

These supports are required to have a uniform conductivity and also it is important for them to have a smooth surface. The surface smoothness has a great influence on the uniformity of the subbing layer, charge generation layer and charge transport layer to be formed on that surface. Accordingly, the support used may preferably have a surface roughness of 0.3 μm or smaller. Unevenness of 0.3 μm or larger may greatly change local electric fields applied to thin layers such as the subbing layer and the charge generation layer to cause a great change in their properties, tending to cause difficulties such as electric-charge injection and uneven residual potential undesirably.

Meanwhile, in an instance where exposure is effected using a coherent light source such as a laser, an unevenness may be formed on the surface of the support in order to prevent image deterioration. In this instance, an unevenness of about ½ λ of a wavelength used may preferably be formed at a period of 10 μm or less so that the difficulties such as electric-charge injection and uneven residual potential may hardly occur.

In the present invention, a subbing layer having the function of charge injection blocking and the function of adhesion may be provided between the support and the photosensitive layer. The subbing layer may be formed of a material including casein, polyvinyl alcohol, nitrocellulose, an ethylene-acrylic acid copolymer, polyvinyl butyral, phenolic resin, polyamide, polyurethane or gelatin. The subbing layer may preferably have a layer thickness of from 0.1 to 10 μm, and particularly preferably from 0.3 to 3 μm.

As the photosensitive layer, usable are a function-separated type having a charge generation layer containing a charge-generating material and a charge transport layer containing a charge-transporting material, and a single-layer type containing a charge-generating material and a charge-transporting material in the same layer. In the photosensitive layer of the function-separated type, referring to the configuration of the photosensitive layer, the charge transport layer may be superposed on the charge generation layer or the charge generation layer may be superposed on the charge transport layer. Of these photosensitive layers, the photosensitive layer of a function-separated type in which the charge transport layer is superposed on the charge generation layer is preferred in view of electrophotographic performance. In either type, at least the surface layer of the electrophotographic photosensitive member contains the polycarbonate resin having a structural unit represented by Formula (1).

The charge generation layer may be formed by applying a dispersion prepared by dispersing a charge-generating material in a binder resin, followed by drying.

As the charge-generating material, usable are, e.g., selenium-tellurium, pyrylium dyes, thiopyrylium dyes, phthalocyanine pigments, anthanthrone pigments, dibenzpyrenequinone pigments, pyranthrone pigments, azo pigments, indigo pigments, quinacridone pigments and cyanine pigments. Of these charge generation layers, azo pigments and phthalocyanine pigments are particularly suited in the present invention. The phthalocyanine pigments may include metal-free phthalocyanine, copper phthalocyanine, gallium phthalocyanine and oxytitanium phthalocyanine. In particular, oxytitanium phthalocyanine is preferred as having a high sensitivity to long-wavelength light, which is disclosed in, e.g., Japanese Patent Applications Laid-open No. 61-239248, No. 62-67094, No. 3-128973 and No. 3-200790. Of these, more preferred is oxytitanium phthalocyanine having distinctive peaks at Bragg's angles ($2\theta \pm 0.2°$) of 9.0°, 14.2°, 23.9° and 27.1° in CuKα characteristic X-ray diffraction, disclosed in Japanese Patent Application Laid-open No. 3-128973.

The binder resin is the resin specified in the present invention when the charge generation layer is the surface layer. When the charge generation layer is not the surface layer, the binder resin may be selected from a vast range of insulating resins, as exemplified by polyvinyl butyral, polyvinyl alcohol, polyarylates, polyamides, acrylic resins, polyvinyl acetate, phenolic resins, epoxy resins, polyesters, polycarbonates, polyurethanes and cellulose resins. The binder resin contained in the charge generation layer may preferably be in an amount not more than 80% by weight or less, and particularly preferably not more than 50% by weight.

The charge generation layer may preferably have a layer thickness of 5 μm or smaller, and particularly preferably from 0.05 to 2 μm.

The charge transport layer may be formed by applying a coating solution prepared by chiefly dissolving a charge-generating material and a binder resin in a solvent, followed by drying. The charge-transporting material may include triarylamine compounds, hydrazone compounds, stilbene compounds, pyrazoline compounds, oxazole compounds, triallylmethane compounds and thiazole compounds. The binder resin is the resin specified in the present invention when the charge transport layer is the surface layer. When the charge generation layer is not the surface layer, the binder resin may include conventionally known various resins.

Any of these charge-transporting materials may be applied in combination with the binder resin 0.5 to 2.0 times as much as the charge-transporting material, followed by drying to form the charge transport layer. In the present invention, the charge transport layer may preferably have a layer thickness of from 1 to 40 μm, and particularly preferably from 3 to 30 μm.

In the photosensitive layer, additives may be used in addition to the above compounds in order to improve mechanical strength and durability. Usable additives include antioxidants, ultraviolet light absorbers, stabilizers, cross-linking agents, lubricants and conductivity control agents.

In the present invention, a layer containing the resin specified in the present invention may optionally be provided as a protective layer on the photosensitive layer.

The process cartridge and electrophotographic apparatus of the present invention will be described below.

FIGURE schematically illustrates the construction of an electrophotographic apparatus having a process cartridge having the electrophotographic photosensitive member of the present invention. In FIGURE, reference numeral 1 denotes a drum type electrophotographic photosensitive member of the present invention, which is rotatively driven around an axis 2 in the direction of an arrow at a predetermined peripheral speed. The photosensitive member 1 is uniformly electrostatically charged on its periphery to a positive or negative, given potential through a primary charging means 3. The photosensitive member thus charged is then exposed to light 4 emitted from an exposure means (not shown) for slit exposure or laser beam scanning exposure. In this way, electrostatic latent images are successively formed on the periphery of the photosensitive member 1.

The electrostatic latent images thus formed are subsequently developed with toner by the operation of a developing means 5. The resulting toner-developed images are then successively transferred by the operation of a transfer means 6, to the surface of a transfer medium 7 fed from a paper feed section (not shown) to the part between the photosensitive member 1 and the transfer means 6 in the manner synchronized with the rotation of the photosensitive member 1. The transfer medium 7 on which the images have been transferred is separated from the surface of the photosensitive member, is led through an image fixing means 8, where the images are fixed, and is then printed out of the apparatus as a copied material (a copy).

The surface of the photosensitive member 1 from which images have been transferred is brought to removal of the toner remaining after the transfer, through a cleaning means 9. Thus the photosensitive member is cleaned on its surface, further subjected to charge elimination by pre-exposure light 10 emitted from a pre-exposure means (not shown), and then repeatedly used for the formation of images. When the primary charging means 3 is a contact charging means making use of a charging roller, the pre-exposure is not necessarily required.

In the present invention, the apparatus may be constituted of a combination of components integrally joined as a process cartridge, the components being selected from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, at least one of the primary charging means 3, the developing means 5 and the cleaning means 9 may be integrally supported in a cartridge together with the photosensitive member 1 to form a process cartridge 11 that is detachably mountable to the body of the apparatus through a guide means such as a rail 12 provided in the body of the apparatus.

In the case when the electrophotographic apparatus is used as a copying machine or a printer, the exposure light 4 is a light reflected from, or transmitted through, an original, or light irradiated by the scanning of a laser beam, the driving of an LED array or the driving of a liquid crystal shutter array according to signals obtained by reading an original through a sensor and converting the information into signals.

The electrophotographic photosensitive member of the present invention may be not only applied in electrophotographic copying machines, but also widely applied in the fields where electrophotography is applied, e.g., laser beam printers, CRT printers, LED printers, liquid-crystal printers and laser beam engravers.

A synthesis example of the polycarbonate resin used in the present invention is shown below.

SYNTHESIS EXAMPLE

In 42 liters of water, 3.7 kg of sodium hydroxide was dissolved. To the solution obtained, 2.77 kg of 2,2-bis(4-hydroxyphenyl)propanol, 6.59 kg of 9,9-bis(4-hydroxy-3-methylphenyl)fluorene and 8 g of hydrosulfite were dissolved while keeping the solution at 20° C. After further adding 28 liters of methylene chloride, 78 g of p-tert-butylphenol was added with stirring, and then 2.34 kg of phosgene was blown into the resulting mixture over a period of 60 minutes. After the phosgene was blown, the reaction mixture was vigorously stirred to emulsify it. After its emulsification, 8 g of triethylamine was added. The mixture obtained was stirred for about 60 minutes to carry out polymerization. The polymerization mixture was separated into an aqueous phase and an organic phase, and the organic phase was neutralized with phosphoric acid. Thereafter, water washing was repeated until the pH of the washing became neutral, followed by the addition of 35 liters of isopropanol to make a polymer precipitate. The precipitate obtained was filtered, followed by drying to obtain a white powdery polycarbonate resin.

The present invention will be described below in greater detail by giving Examples.

EXAMPLE 1

On an aluminum cylinder of 30 mm in external diameter, obtained by a drawing process, a fluid prepared by dissolving 167 parts (parts by weight; the same applies hereinafter) of phenolic resin (trade name: PLYOPHEN; available from Dainippon Ink & Chemicals, Incorporated) in 100 parts of methyl cellosolve and dispersing in the solution obtained 200 parts of conductive ultrafine barium particles (primary particle diameter: 50 nm) and 3 parts of silicone resin particles of 2 $\mu$m in average particle diameter was applied by dip coating, followed by drying to form a conductive layer with a layer thickness of 15 $\mu$m.

On the conductive layer, a solution prepared by dissolving 5 parts of an alcohol-soluble copolymer nylon (trade name: AMILAN CM-8000; available from Toray Industries, Inc.) was applied by dip coating, followed by drying at 80° C. for 10 minutes to form a subbing layer with a layer thickness of 0.5 $\mu$m.

Next, to prepare a charge generation layer coating solution, 5 parts of an oxytitanium phthalocyanine pigment having intense peaks at Bragg's angles (2θ±0.2°) of 9.0°, 14.2°, 23.9° and 27.9° in CuKα characteristic X-ray diffraction was added in a solution prepared by dissolving 2 parts of polyvinyl benzal (degree of benzalation: 75% or more) in 95 parts of cyclohexanone, followed by dispersion for 2 hours by means of a sand mill. The dispersion obtained was applied on the subbing layer previously formed, by dip coating so as to be in a dried-layer thickness of 0.2 $\mu$m, followed by drying to form a charge generation layer.

Next, a charge transport layer coating solution prepared by dissolving 10 parts of the polycarbonate resin obtained in Synthesis Example given above and 9 parts of an amine having the following structural formula:

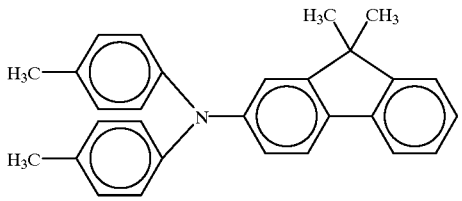

in a mixed solvent of 50 parts of chlorobenzene and 30 parts of dichloromethane was applied onto the charge generation layer by dip coating, followed by drying at 120° C. for 2 hours to form a transparent and uniform charge transport layer with a layer thickness of 20 $\mu$m. Thus, an electrophotographic photosensitive member was produced.

The electrophotographic photosensitive member thus produced was charged at −600 V, and its electrophotographic performance was measured using a light of 680 nm in wavelength. As a result, E½ (the amount of exposure that is necessary for the charge potential to attenuate to −300 V) was 0.16 J/cm$^2$ and the residual potential was −26 V, showing good results.

This electrophotographic photosensitive member was set in a remodeled machine of a laser beam printer LASER JET 4 PLUS, manufactured by Hewlett Packard Co. (so remodeled as to change 1/e$^2$ to irradiation spot diameters of 65 $\mu$m and 30 $\mu$m in the secondary scanning direction and primary scanning direction, respectively), to make an image evaluation under the initial-stage charging set at −600 V. As a result, no image deterioration was seen even after running on 4,000 sheets and good images were obtained.

The charge transport layer coating solution used in the present Example was left standing for a week at room temperature (23° C.) in a hermetically closed container. Thereafter, the dissolution state was observed to find that no gelation was seen in the coating solution.

Comparative Example 1

An electrophotographic photosensitive member was attempted to be produced in the same manner as in Example 1 except that the binder resins for the charge transport layer was replaced with only a polycarbonate resin obtained using as a starting material 9,9-bis(4-hydroxy-3-methylphenyl) fluorene (Exemplary Compound 1). However, the polymer was not well dissolved in the solvent, and it was unable to produce the photosensitive member.

EXAMPLE 2

On the same aluminum cylinder as used in Example 1, a fluid prepared by dissolving 167 parts of phenolic resin (the same one as Example 1) in 100 parts of methyl cellosolve and dispersing in the solution obtained 200 parts of conductive ultrafine barium particles (primary particle diameter: 50 nm) was applied by dip coating, followed by drying to form a conductive layer with a layer thickness of 10 $\mu$m.

On the conductive layer, a subbing layer with a layer thickness of 1 $\mu$m and a charge generation layer with a layer thickness of 0.2 $\mu$m were formed in the same manner as in Example 1.

Next, a charge transport layer was formed thereon in the same manner as in Example 1 except that the polycarbonate resin obtained in Synthesis Example given above and a polycarbonate resin obtained using bis(4-hydroxyphenyl) methane as a starting material were used as binder resins.

The electrophotographic photosensitive member thus produced was evaluated in the same manner as in Example 1. As a result, E½ was 0.15 J/cm$^2$ and the residual potential was −26 V, showing good results.

This electrophotographic photosensitive member was set in the same laser beam printer as used in Example 1 to make an image evaluation under the initial-stage charging set at −600 V. As a result, no image deterioration was seen even after running on 4,000 sheets and good images were obtained.

The charge transport layer coating solution used in the present Example was left standing for a week at room temperature (23° C.) in a hermetically closed container.

Thereafter, the dissolution state was observed to find that no gelation was seen in the coating solution.

Comparative Example 2

The procedure of Example 1 was repeated up to the formation of the charge generation layer.

Next, a charge transport layer coating solution prepared by dissolving in 70 parts of chlorobenzene 6 parts of a triarylamine having the following structural formula:

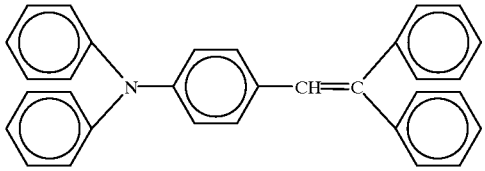

and 6 parts of a polycarbonate resin obtained from 1,1-bis (hydroxyphenyl)cyclohexane was applied onto the charge generation layer by dip coating, followed by drying to form a charge transport layer with a layer thickness of 20 $\mu$m. Thus, an electrophotographic photosensitive member was produced.

This electrophotographic photosensitive member was evaluated in the same manner as in Example 1. As a result, E½ was 0.31 J/cm$^2$ and the residual potential was −98 V, showing great values.

This electrophotographic photosensitive member was set in the same laser beam printer as used in Example 1 to make an image evaluation under the initial-stage charging set at −600 V. As a result, interference fringes and black dots were perceivable after 4,000-sheet running and good images were not obtainable.

The charge transport layer coating solution used in the present Comparative Example was left standing for a week at room temperature (23° C.) in a hermetically closed container. Thereafter, the dissolution state was observed to find that no gelation was seen in the coating solution.

EXAMPLE 3

An electrophotographic photosensitive member was produced in the same manner as in Example 1 except that as the binder resin for the charge transport layer a copolymer polycarbonate resin was used which was obtained using 2,2-bis(4-hydroxyphenyl)propanol and α,ω-bis[3-(o-hydroxyphenyl)propyl]polydimethyl-siloxane in a molar ratio of 10:1.

This electrophotographic photosensitive member was evaluated in the same manner as in Example 1. As a result, E½ was 0.19 J/cm$^2$ and the residual potential was −28 V, showing good results.

This electrophotographic photosensitive member was set in the same laser beam printer as used in Example 1 to make an image evaluation under the initial-stage charging set at −600 V. As a result, no image deterioration was seen even after running on 4,000 sheets and good images were obtained.

The charge transport layer coating solution used in the present Example was left standing for a week at room temperature (23° C.) in a hermetically closed container. Thereafter, the dissolution state was observed to find that no gelation was seen in the coating solution.

EXAMPLE 4

An electrophotographic photosensitive member was produced in the same manner as in Example 1 except that as the binder resin for the charge transport layer a terpolymer polycarbonate resin was used which was obtained using 2,2-bis(4-hydroxyphenyl)propanol, 9,9-bis(4-hydroxy-3-methylphenyl)fluorene and α,ω-bis[3-(o-hydroxyphenyl) propyl]polydimethylsiloxane in a molar ratio of 4:10:1.

This electrophotographic photosensitive member was evaluated in the same manner as in Example 1. As a result, E½ was 0.15 J/cm$^2$ and the residual potential was −25 V.

This electrophotographic photosensitive member was set in the same laser beam printer as used in Example 1 to make an image evaluation under the initial-stage charging set at −600 V. As a result, no image deterioration was seen even after running on 4,000 sheets and good images were obtained.

The charge transport layer coating solution used in the present Example was left standing for a week at room temperature (23° C.) in a hermetically closed container. Thereafter, the dissolution state was observed to find that no gelation was seen in the coating solution.

Comparative Example 3

An electrophotographic photosensitive member was produced in the same manner as in Example 1 except that as the binder resin for the charge transport layer a polycarbonate resin obtained from 2,2-bis(4-hydroxyphenyl)propane was used.

This electrophotographic photosensitive member was evaluated in the same manner as in Example 1. As a result, E½ was 0.29 J/cm$^2$ and the residual potential was −75 V.

This electrophotographic photosensitive member was set in the same laser beam printer as used in Example 1 to make an image evaluation under the initial-stage charging set at −600 V. As a result, interference fringes and black dots were perceivable after 4,000-sheet running and good images were not obtainable.

The charge transport layer coating solution used in the present Comparative Example was left standing for a week at room temperature (23° C.) in a hermetically closed container. Thereafter, the dissolution state was observed to find that gelation was seen in the coating solution.

Comparative Example 4

An electrophotographic photosensitive member was produced in the same manner as in Example 1 except that as the binder resin for the charge transport layer a copolymer polycarbonate resin was used which was obtained using 9,9-bis(4-hydroxy-3-methylphenyl)fluorene and 2,2-bis(4-hydroxyphenyl)propane in a molar ratio of 1:1.

This electrophotographic photosensitive member was evaluated in the same manner as in Example 1. As a result, E½ was 0.22 J/cm$^2$ and the residual potential was −31 V.

This electrophotographic photosensitive member was set in the same laser beam printer as used in Example 1 to make an image evaluation under the initial-stage charging set at −600 V. As a result, no image deterioration was seen even after running on 4,000 sheets and good images were obtained.

However, when the charge transport layer coating solution used in the present Comparative Example was left standing for a week at room temperature (23 °C.) in a hermetically closed container and thereafter the dissolution state was observed, gelation was seen in the coating solution.

What is claimed is:

1. An electrophotographic photosensitive member comprising a support and a photosensitive layer provided on the support;

said electrophotographic photosensitive member having a surface layer which contains a polycarbonate resin having a structural unit represented by the following Formula (1):

(1)

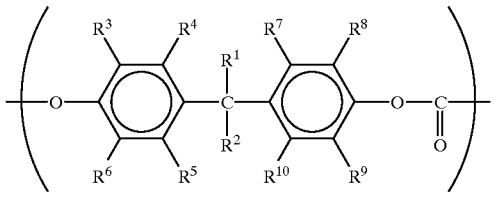

wherein $R^1$ represents a hydrogen atom, a halogen atom, a substituted or unsubstituted alkyl group, a substituted or unsubstituted aryl group, or a substituted or unsubstituted alkenyl group; $R^2$ represents an alkyl group having a hydroxyl group; and $R^3$ to $R^{10}$ each represent a hydrogen atom, a halogen atom, a substituted or unsubstituted alkyl group, a substituted or unsubstituted aryl group, a substituted or unsubstituted alkenyl group, a substituted or unsubstituted alkoxyl group, or a substituted or unsubstituted aralkyl group.

2. An electrophotographic photosensitive member according to claim 1, wherein the structural unit represented by Formula (1) is one derived from 2,2-bis(4-hydroxyphenyl) propanol.

3. An electrophotographic photosensitive member according to claim 1 or 2, wherein said polycarbonate resin further has a structural unit represented by the following Formula (3):

(3)

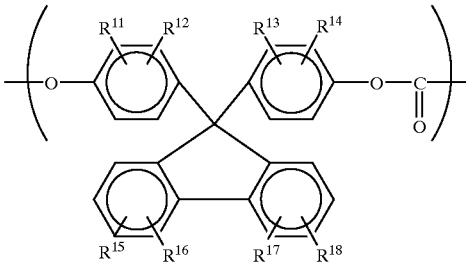

wherein $R^{11}$ to $R^{18}$ each represent a hydrogen atom, a halogen atom, a substituted or unsubstituted alkyl group, a substituted or unsubstituted aryl group, a substituted or unsubstituted alkenyl group, a substituted or unsubstituted alkoxyl group, or a substituted aralkyl group.

4. An electrophotographic photosensitive member according to claim 3, wherein the structural unit represented by Formula (3) is one derived from 9,9-bis(4-hydroxy-3-methylphenyl)fluorene.

5. An electrophotographic photosensitive member according to claim 1 or 2, wherein said surface layer further contains a polycarbonate resin having a structural unit represented by Formula (3):

(3)

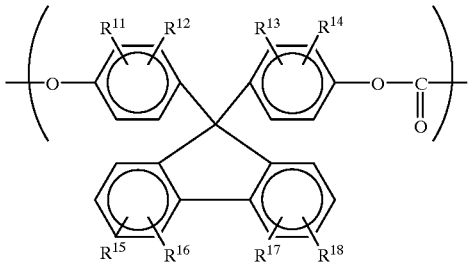

wherein $R^{11}$ to $R^{18}$ each represent a hydrogen atom, a halogen atom, a substituted or unsubstituted alkyl group, a substituted or unsubstituted aryl group, a substituted or unsubstituted alkenyl group, a substituted or unsubstituted alkoxyl group, or a substituted aralkyl group.

6. An electrophotographic photosensitive member according to claim 5, wherein the structural unit represented by Formula (3) is one derived from 9,9-bis(4-hydroxy-3-methylphenyl)fluorene.

7. A process cartridge comprising an electrophotographic photosensitive member and at least one means selected from the group consisting of a charging means, a developing means and a cleaning means;

said electrophotographic photosensitive member and at least one of said means being supported as one unit and being detachably mountable on the main body of an electrophotographic apparatus; and said electrophotographic photosensitive member comprising a support and a photosensitive layer provided on the support;

said electrophotographic photosensitive member having a surface layer which contains a polycarbonate resin having a structural unit represented by the following Formula (1):

(1)

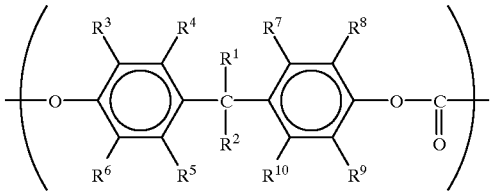

wherein $R^1$ represents a hydrogen atom, a halogen atom, a substituted or unsubstituted alkyl group, a substituted or unsubstituted aryl group, or a substituted or unsubstituted alkenyl group; $R^2$ represents an alkyl group having a hydroxyl group; and $R^3$ to $R^{10}$ each represent a hydrogen atom, a halogen atom, a substituted or unsubstituted alkyl group, a substituted or unsubstituted aryl group, a substituted or unsubstituted alkenyl group, a substituted or unsubstituted alkoxyl group, or a substituted or unsubstituted aralkyl group.

8. An electrophotographic apparatus comprising an electrophotographic photosensitive member, a charging means, an exposure means, a developing means and a transfer means;

said electrophotographic photosensitive member comprising a support and a photosensitive layer provided on the support;

said electrophotographic photosensitive member having a surface layer which contains a polycarbonate resin having a structural unit represented by the following Formula (1):

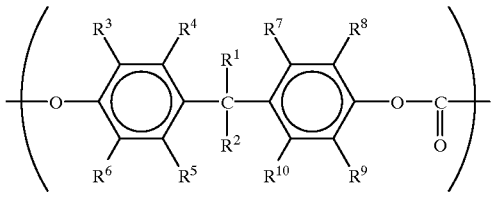

(1)

wherein $R^1$ represents a hydrogen atom, a halogen atom, a substituted or unsubstituted alkyl group, a substituted or unsubstituted aryl group, or a substituted or unsubstituted alkenyl group; $R^2$ represents an alkyl group having a hydroxyl group; and $R^3$ to $R^{10}$ each represent a hydrogen atom, a halogen atom, a substituted or unsubstituted alkyl group, a substituted or unsubstituted aryl group, a substituted or unsubstituted alkenyl group, a substituted or unsubstituted alkoxyl group, or a substituted or unsubstituted aralkyl group.

* * * * *